US008764400B2

(12) United States Patent
Kerr

(10) Patent No.: US 8,764,400 B2
(45) Date of Patent: Jul. 1, 2014

(54) BLOWER FOR A PARTICULATE LOADER AND TRANSFER APPARATUS

(75) Inventor: Paul Kerr, Hodgeville (CA)

(73) Assignee: AG Growth Industries Partnership, Manitoba (CA)

( * ) Notice: Subject to any disclaimer, the term of this patent is extended or adjusted under 35 U.S.C. 154(b) by 430 days.

(21) Appl. No.: 12/533,729

(22) Filed: Jul. 31, 2009

(65) Prior Publication Data

US 2011/0027094 A1 Feb. 3, 2011

(51) Int. Cl.
*F04D 17/10* (2006.01)

(52) U.S. Cl.
USPC ..... 416/185; 416/214 R

(58) Field of Classification Search
USPC ..... 416/182, 183, 185, 186 R, 187, 214 R, 416/202
See application file for complete search history.

(56) References Cited

U.S. PATENT DOCUMENTS

| | | | | | |
|---|---|---|---|---|---|
| 1,947,658 | A * | 2/1934 | Pizzuto | 416/182 |
| 2,106,040 | A * | 1/1938 | Schmidt | 416/183 |
| 2,458,258 | A * | 1/1949 | Furr | 15/340.1 |
| 2,633,390 | A * | 3/1953 | Bush | 406/97 |
| 3,285,187 | A * | 11/1966 | Anderson, Jr. | 416/183 |
| 4,249,863 | A * | 2/1981 | Connolly et al. | 416/185 |
| 4,344,723 | A * | 8/1982 | Ellingson | 406/53 |
| 4,428,717 | A * | 1/1984 | Catterfeld | 416/186 R |
| 4,560,307 | A * | 12/1985 | Deitesfeld | 406/63 |
| 4,881,855 | A * | 11/1989 | Rempel et al. | 406/53 |
| 4,900,228 | A * | 2/1990 | Yapp | 416/183 |
| 5,044,887 | A * | 9/1991 | Duthie et al. | 416/223 B |
| 6,471,476 | B1 * | 10/2002 | Diels et al. | 416/1 |
| 6,629,818 | B2 * | 10/2003 | Svoboda | 415/121.1 |
| 7,431,537 | B2 * | 10/2008 | Francis et al. | 406/53 |
| 7,597,541 | B2 * | 10/2009 | White | 416/183 |
| 7,862,260 | B2 * | 1/2011 | Rempel | 406/53 |
| 7,959,697 | B2 * | 6/2011 | Francis | 55/385.1 |
| 2003/0017048 | A1 * | 1/2003 | Lin | 415/206 |
| 2003/0133801 | A1 * | 7/2003 | Orocio et al. | 416/186 R |
| 2004/0003481 | A1 * | 1/2004 | Tarrant | 15/340.1 |
| 2004/0177470 | A1 * | 9/2004 | Tarrant | 15/340.1 |
| 2006/0222498 | A1 * | 10/2006 | Yoshida et al. | 416/182 |
| 2012/0121399 | A1 * | 5/2012 | Kerr et al. | 415/203 |

OTHER PUBLICATIONS

Greenheck Product Application Guide, "A technical bulletin for engineers, contractors and students in the air movement and control industry", copyright 2006 by Greenheck Fan Corp.*

Internet screenshot of Dynair Product Guide for PS-L unit, copyright 2008 by Maico Italia S.p.A.*

Frank P. Bleier, "Centrifugal Fans", Fan Handbook—Selection, Application and Design, Chapter 7, McGraw-Hill 1998.

* cited by examiner

*Primary Examiner* — Edward Look
*Assistant Examiner* — Christopher R Legendre
(74) *Attorney, Agent, or Firm* — Katten Muchin Rosenman LLP

(57) ABSTRACT

A blower for a particulate loader and transfer apparatus is provided. The blower comprises at least one blade having a proximal and a distal end. A drive mechanism rotates the at least one blade in a direction about an axis of rotation. The proximal end of the blade is nearer to the axis of rotation than the distal end of the blade is to the axis of rotation and the blade is angled so that as the blade rotates about the axis, the proximal end of the blade precedes the distal end of the blade.

11 Claims, 7 Drawing Sheets

52
58
56
54
71
69
50

58
56
50
62B
62A 64
66
88
86
69
50
52
54
71
60
62

70
54
71
58
56
69
50

58
56
50
62A
62B 70
54
50
86
88
64
66
69
71
62
60

58
56
62A
50
62B 90
50
69
71

60
51
91
90
54
86
88
92
50
69
71
62

71
69
63
100

88
86
71
101
100
51
69
60
62B
66

58
69
56
50
62A
62B 60
63
65
58
67

BLOWER FOR A PARTICULATE LOADER AND TRANSFER APPARATUS

FIELD OF THE INVENTION

The present invention relates to a high capacity particulate loader and transfer apparatus of grain, fertilizer, chemicals, particulates and granular material (hereinafter referred to as "particulates"), and more particularly, relates to an improved blower for a particulate loader and transfer apparatus.

BACKGROUND OF THE INVENTION

Particulate loader and transfer devices are well known, and as described in U.S. Pat. No. 7,431,537, may be used by farmers and others to load and transfer grain and other particulate materials in a convenient manner. These devices may include, for example, one or more blowers to create suction within an air-materials separation chamber and a vacuum pickup hose attached thereto, to transport grain or other materials from one location, into the air-materials separation chamber in the bottom of which is positioned an auger for transferring the grain or other particulate material from the air-materials separation chamber into, for example an open truck, container or other location.

Generally, the blower includes either a radial or centrifugal blower which draws the air from the air-materials separation chamber and the vacuum pickup hose extending therefrom, and exhausts the air to the atmosphere in an area adjacent to the particulate loader and transfer device. The radial or centrifugal blowers are useful in transporting large volumes of air and particulate material quickly and efficiently, which is particularly desirable in the context of particulate loader and transfer devices.

It is desirable to provide a particulate loader and transfer device with improved suction characteristics, for example, to enhance suction in the air-materials separation chamber and the vacuum pickup hose extending therefrom, to increase the distance that the particulate material can travel within the vacuum pickup hose, and to provide additional suction at the open end of and along the length of the vacuum pickup hose in the event that the particulate material is difficult to move or is fully or partially blocking the vacuum pickup hose.

SUMMARY OF THE INVENTION

Accordingly, one object of the present invention is to provide a particulate loader and transfer device with improved suction characteristics, for example, to enhance suction in the air-materials separation chamber and the vacuum pickup hose extending therefrom, to increase the distance that the particulate material can travel within the vacuum pickup hose.

Another object of the present invention is to provide a particulate loader and transfer device with improved suction characteristics, for example, to provide additional suction at the open end of and along the length of the vacuum pickup hose in the event that the particulate material is difficult to move or is fully or partially blocking the vacuum pickup hose.

According to one aspect of the present invention, there is provided a blower for a particulate loader and transfer apparatus, comprising, at least one blade having a proximal and distal end, means for rotating the at least one blade in a direction about an axis of rotation, wherein the proximal end of the blade is nearer to the axis of rotation than the distal end of the blade is to the axis of rotation and wherein the blade is angled so that as the blade rotates about the axis, the proximal end of the blade precedes the distal end of the blade.

An advantage of the present invention is that it provides a particulate loader and transfer device with improved suction characteristics, for example, to enhance suction in the air-materials separation chamber and the vacuum pickup hose extending therefrom, to increase the distance that the particulate material can travel within the vacuum pickup hose.

A further advantage of the present invention is that it provides a particulate loader and transfer device with improved suction characteristics, for example, to provide additional suction at the open end of and along the length of the vacuum pickup hose in the event that the particulate material is difficult to move or is fully or partially blocking the vacuum pickup hose.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

Figure 1A:
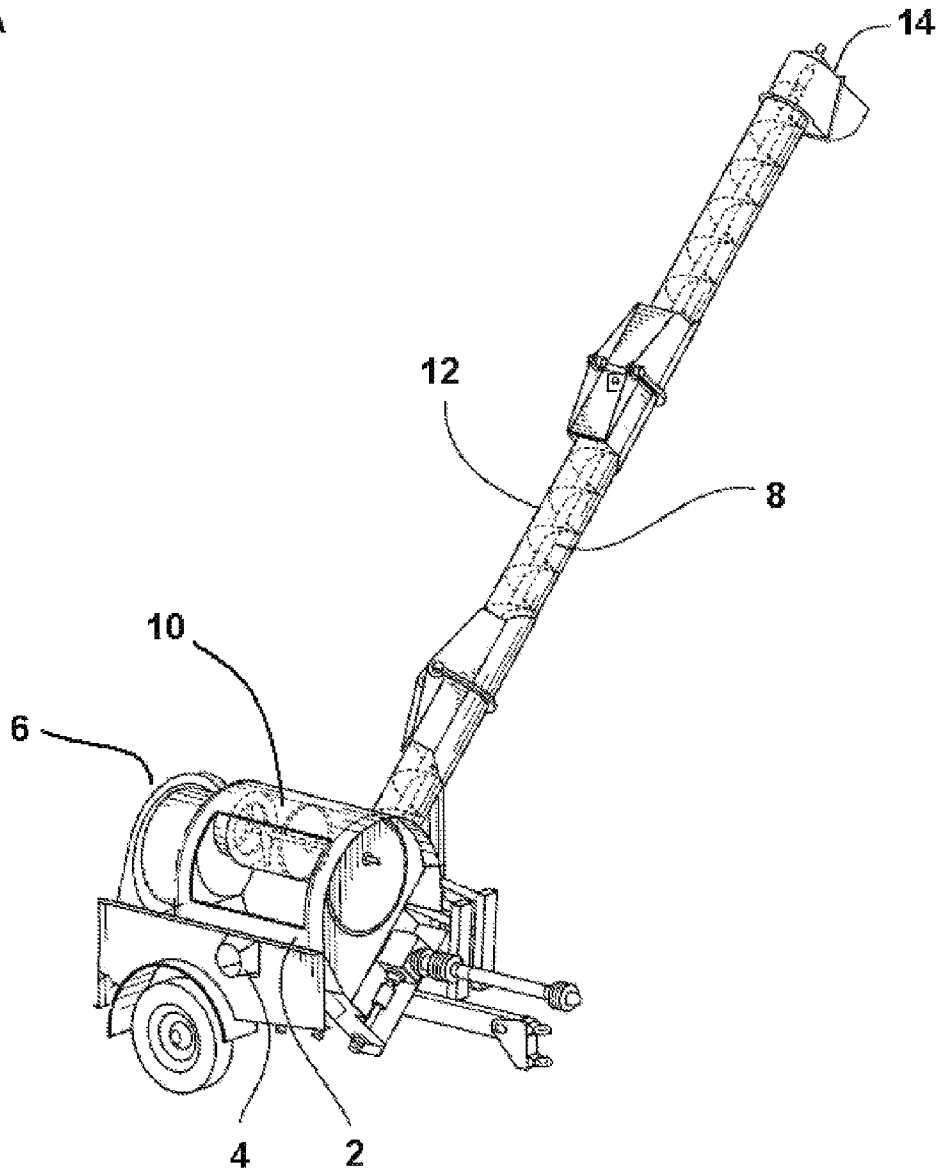
FIG. 1A is a front perspective view, partially in ghost, of a particulate loader and transfer apparatus.
Figure 1B:
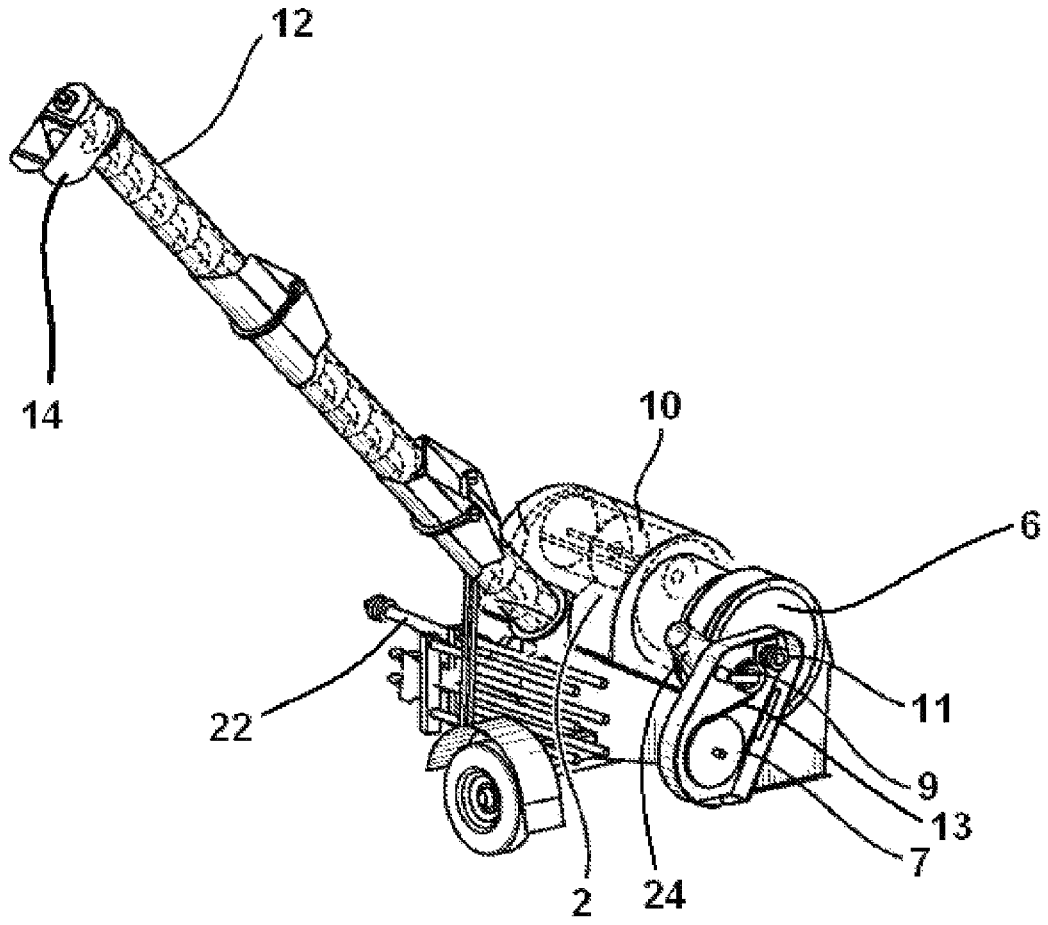
FIG. 1B is a rear perspective view, partially in ghost, of the particulate loader and transfer apparatus illustrated in FIG. 1A.

In a particulate loader and transfer apparatus of the present invention such as is illustrated in FIGS. 1A and 1B, an air-material separating chamber 2 is generally provided, having an inlet 4 which is adapted to connect to a vacuum pickup hose (not shown), relatively low pressure being created within the air-material separating chamber 2 and the vacuum pickup hose by way of one or more blowers 6 in communication with the air-material separating chamber 2, the particulate material being drawn through the vacuum pickup hose and inlet 4 and into the air-material separating chamber 2 as a result of the relatively low pressure within the air-material separating chamber 2, the particulate material thereafter separating itself from the airflow within the air-material separating chamber 2 (the air-material separation being aided by a separating drum 10 within the air-material separating chamber 2 through which separating drum 10 only air and small particles may pass) the particulate material falling onto an auger 8 which extends generally upwardly and outwardly from the air-material separating chamber 2 and which transports the particulate material from the bottom of the air-material separating chamber 2, within a tubular housing 12 enclosing the auger tube 8, through an end-dump housing 14 to a waiting truck, container or other particulate storage area. As illustrated in FIG. 1B, the blower 6 is, for example, driven by way of a series of pulleys 7, 9 and 11 and a belt arrangement 13 (preferably driven by a power takeoff (not shown) by way of a drive shaft 22 in a conventional manner), a pulley 11 being secured to the blower shaft 66 in a conventional manner to drive the blower shaft 66 and blower 6. The air drawn from the air-material separating chamber 2 by the blower is exhausted to atmosphere by way of an exhaust outlet 24.

Figures 2A, 2B, 2C:
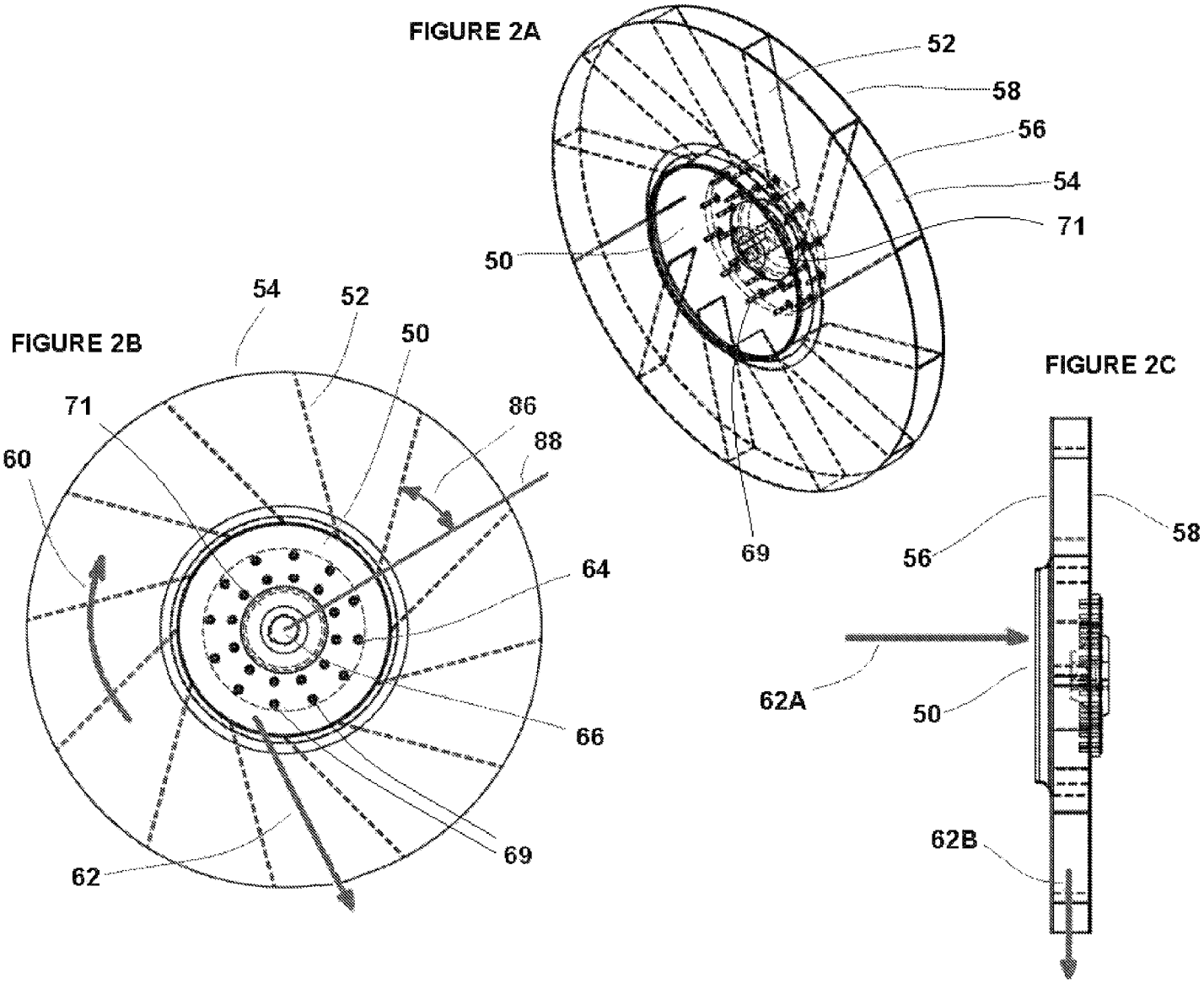
FIG. 2*a* is a perspective view, partially in ghost, of a multiple straight blade blower of one embodiment of the present invention.
FIG. 2*b* is a plan view, partially in ghost, of a multiple straight blade blower of the embodiment of the present invention illustrated in FIG. 2*a;*
FIG. 2*c* is a side view, partially in ghost, of a multiple straight blade blower of the embodiment of the present invention illustrated in FIG. 2*a;*

With reference to FIGS. 2*a*, 2*b*, and 2*c*, in one embodiment of the present invention, the particulate loader and transfer apparatus has a blower 6 as illustrated in FIGS. 2*a*, 2*b*, and 2*c*. In this embodiment of the present invention, the blower 6 preferably has a set of 12 straight steel blades 52, each of which is angled (as illustrated by the arrow 86) relative to a radial reference line 88, and each of which is welded, riveted or otherwise securely fastened to a rear steel rotor plate 58 and to a front steel rotor plate 56 (it being understood that while FIGS. 2*a* and 2*b* illustrate 12 straight steel blades 52, fewer than or more than 12 blades may alternatively be used, and while FIGS. 2*a* and 2*b* illustrate the blades 52 at an angle of approximately 45° to the radial reference line 88, a wide range of angles may alternatively be used, and that in alternative embodiments of the present invention, aluminum or other alternative materials may be used for the blades 52, rear steel rotor plate 58 and front steel rotor plate 56). When the blower is rotated (as indicated by the arrow 60) about the blower shaft 66 to which the rear steel rotor plate 58 is securely fastened (by way of, for example a hub 71 to which the rear steel rotor plate 58 is securely fastened, by way of, for example bolts or rivets 69, the hub 71 being bolted or otherwise securely fastened to the blower shaft in a conventional manner known to a person skilled in the art), air is drawn into the air inlet 50 (as generally indicated by the arrow 62A) and is drawn through the blower to the air outlet 54 (as generally indicated by the arrows 62 and 62B).

Figures 3A, 3B, 3C:
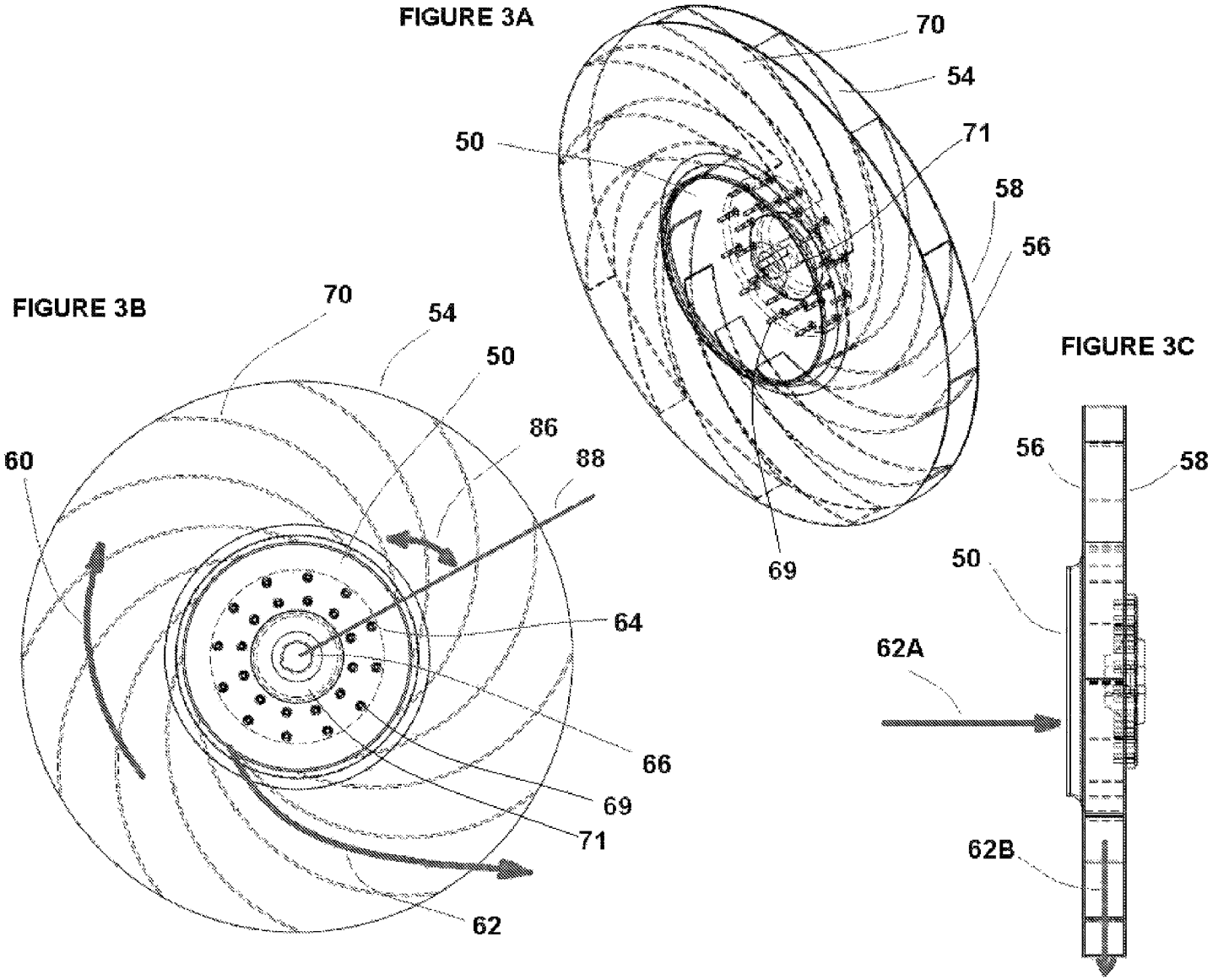
FIG. 3*a* is a perspective view, partially in ghost, of a curved blade blower of one embodiment of the present invention.
FIG. 3*b* is a plan view, partially in ghost, of a curved blade blower of the embodiment of the present invention illustrated in FIG. 3*a;*
FIG. 3*c* is a side view, partially in ghost, of a curved blade blower of the embodiment of the present invention illustrated in FIG. 3*a;*

With reference to FIGS. 3*a*, 3*b*, and 3*c*, in one embodiment of the present invention, the particulate loader and transfer apparatus has a blower 6 as illustrated in FIGS. 3*a*, 3*b*, and 3*c*. In this embodiment of the present invention, the blower 6 preferably has a set of 12 curved steel blades 70, each of which is angled (as illustrated by the arrow 86) relative to a radial reference line 88, and each of which is welded, riveted or otherwise securely fastened to a rear steel rotor plate 58 and to a front steel rotor plate 56 (it being understood that while FIGS. 3*a* and 3*b* illustrate 12 curved steel blades 70, fewer than or more than 12 blades may alternatively be used, and while FIGS. 3*a* and 3*b* illustrate the proximal end of the blades 70 at an angle of approximately 45° to the radial reference line 88, a wide range of angles may alternatively be used, and that in alternative embodiments of the present invention, aluminum or other alternative materials may be used for the blades 70, rear steel rotor plate 58 and front steel rotor plate 56). When the blower is rotated (as indicated by the arrow 60) about the blower shaft 66 to which the rear steel rotor plate 58 is securely fastened (by way of, for example a hub 71 to which the rear steel rotor plate 58 is securely fastened, by way of, for example bolts or rivets 69, the hub 71 being bolted or otherwise securely fastened to the blower shaft in a conventional manner known to a person skilled in the art), air is drawn into the air inlet 50 (as generally indicated by the arrow 62A) and is drawn through the blower to the air outlet 54 (as generally indicated by the arrows 62 and 62B).

Figure 4A:
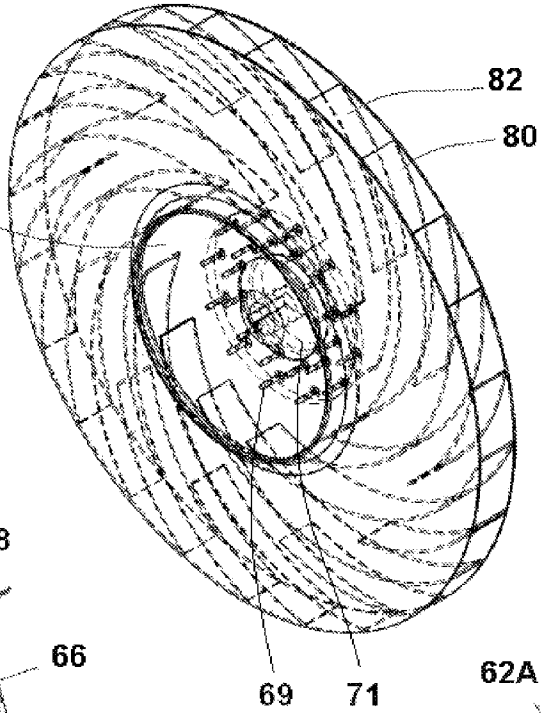
FIG. 4*a* is a perspective view, partially in ghost, of a curved blade blower of one embodiment of the present invention having a set of long curved blades and a set of short curved blades.
Figure 4C:
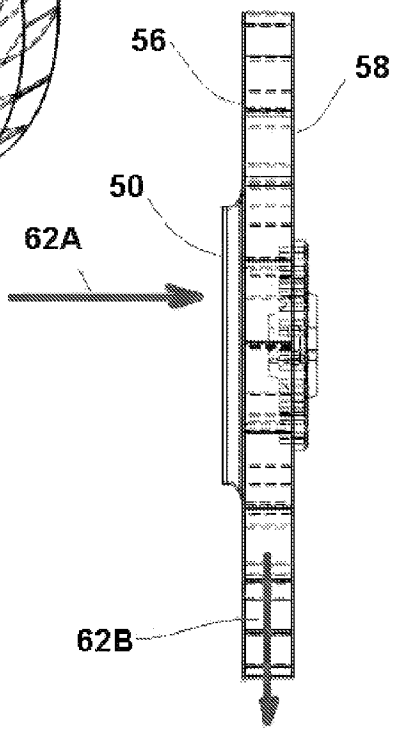
FIG. 4*c* is a side view, partially in ghost, of a curved blade blower of the embodiment of the present invention illustrated in FIG. 4*a;*
Figure 4B:
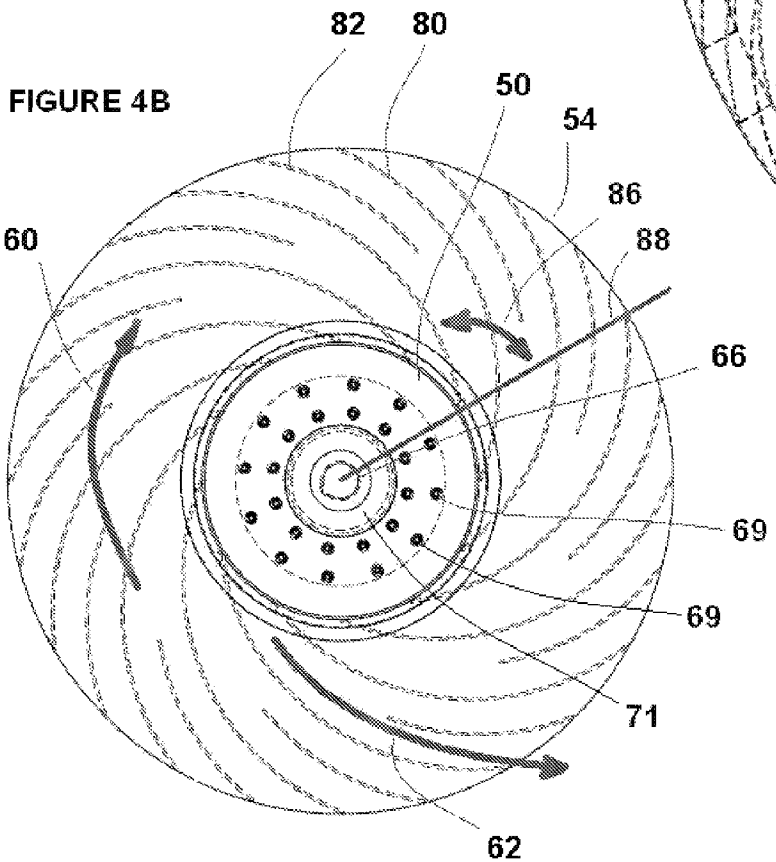
FIG. 4*b* is a plan view, partially in ghost, of a curved blade blower of the embodiment of the present invention illustrated in FIG. 4*a;*

With reference to FIGS. 4*a*, 4*b*, and 4*c*, in one embodiment of the present invention, the particulate loader and transfer apparatus has a blower 6 as illustrated in FIGS. 4*a*, 4*b*, and 4*c*. In this embodiment of the present invention, the blower 6 preferably has a set of 12 long curved steel blades 80, each of which is angled (as illustrated by the arrow 86) relative to a radial reference line 88, and each of which is welded, riveted or otherwise securely fastened to a rear steel rotor plate 58 and to a front steel rotor plate 56, and additionally, has a set of 12 short curved steel blades 82, each of which is alternately between the long curved steel blades 80 (it being understood that while FIGS. 4*a* and 4*b* illustrate 12 long curved steel blades 80 and 12 short curved steel blades, fewer than or more than 12 long blades (and correspondingly fewer or more short blades) may alternatively be used, and while FIGS. 4*a* and 4*b* illustrate the proximal end of the blades 80 at an angle of approximately 45° to the radial reference line 88, a wide range of angles may alternatively be used, and that in alternative embodiments of the present invention, aluminum or other alternative materials may be used for the long curved blades 80, the short curved blades 82, the rear steel rotor plate 58 and front steel rotor plate 56). When the blower is rotated (as indicated by the arrow 60) about the blower shaft 66 to which the rear steel rotor plate 58 is securely fastened (by way of, for example a hub 71 to which the rear steel rotor plate 58 is securely fastened, by way of, for example bolts or rivets 69, the hub 71 being bolted or otherwise securely fastened to the blower shaft in a conventional manner known to a person skilled in the art), air is drawn into the air inlet 50 (as generally indicated by the arrow 62A) and is drawn through the blower to the air outlet 54 (as generally indicated by the arrows 62 and 62B).

Figures 5A, 5B, 5C:
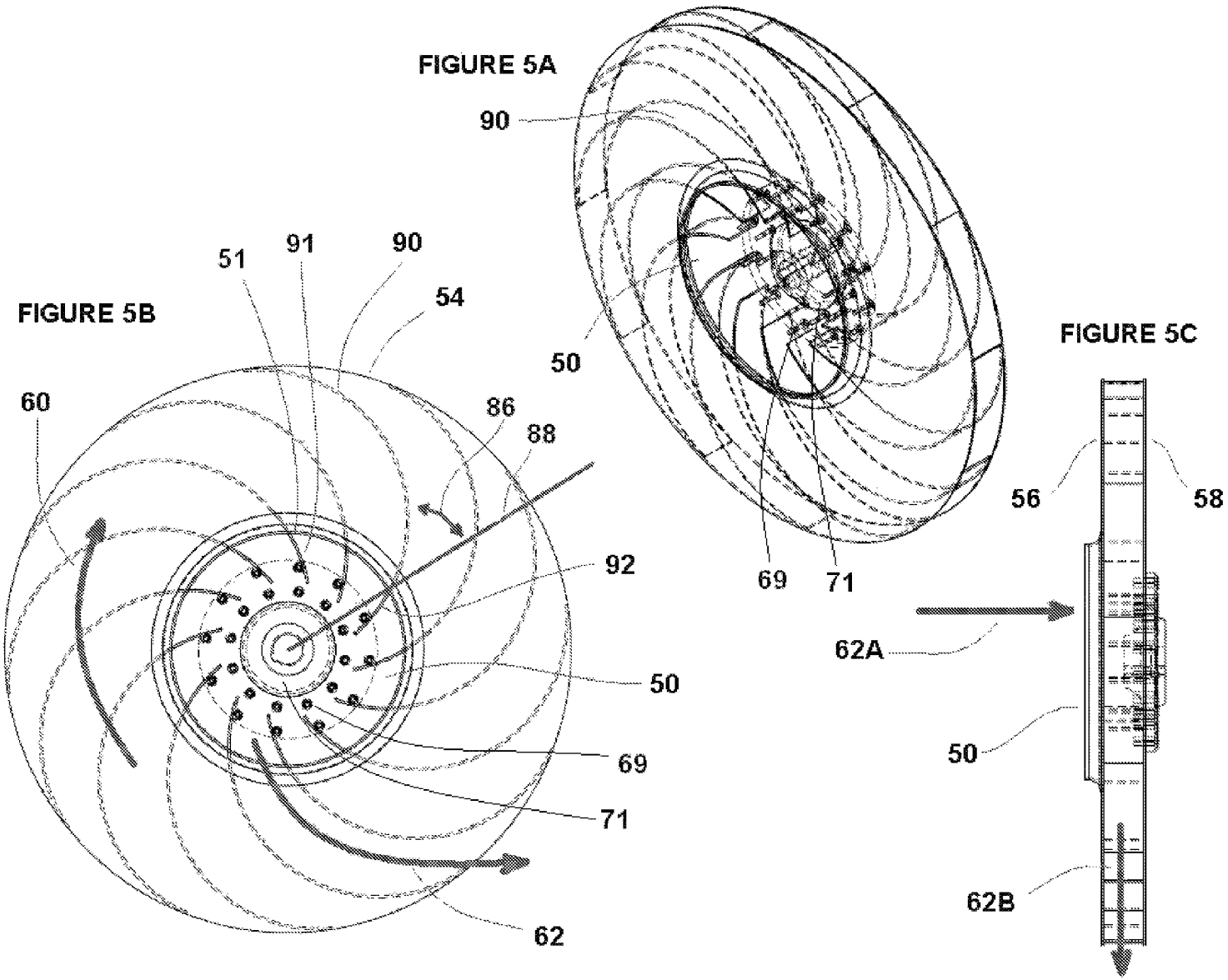
FIG. 5*a* is a perspective view, partially in ghost, of an extended curved blade blower of one embodiment of the present invention having a set of extended curved blades.
FIG. 5*b* is a plan view, partially in ghost, of an extended curved blade blower of the embodiment of the present invention illustrated in FIG. 5*a;*
FIG. 5*c* is a side view, partially in ghost, of an extended curved blade blower of the embodiment of the present invention illustrated in FIG. 5*a;*

With reference to FIGS. 5*a*, 5*b*, and 5*c*, in one embodiment of the present invention, the particulate loader and transfer apparatus has a blower 6 as illustrated in FIGS. 5*a*, 5*b*, and 5*c*. In this embodiment of the present invention, the blower 6 preferably has a set of 12 extended curved steel blades 90, each of which is angled (as illustrated by the arrow 86) relative to a radial reference line 88, and each of which is welded, riveted or otherwise securely fastened to a rear steel rotor plate 58 and to a front steel rotor plate 56 (it being understood that while FIGS. 5*a* and 5*b* illustrate 12 curved steel blades 90, fewer than or more than 12 blades may alternatively be used, and while FIGS. 5*a* and 5*b* illustrate the proximal end of the blades 90 at an angle of approximately 20.degree. −45.degree. to the radial reference line 88, a wide range of angles may alternatively be used, and that in alternative embodiments of the present invention, aluminum or other alternative materials may be used for the blades 90, rear steel rotor plate 58 and front steel rotor plate 56). In this embodiment of the present invention each of the blades 90 extends a short distance 91 beyond the circumference 51 of the inlet 50 (in an alternative embodiment while some of the blades 90 beyond the circumference 51 of the inlet 50, some of the blades 90 extend only to the circumference 51, it being understood that these blades are positioned on the blower 6 in a balanced way so that no portion of the blower is out of balance relative to the other portions of the blower). When the blower is rotated (as indicated by the arrow 60) about the blower shaft 66 to which the rear steel rotor plate 58 is securely fastened (by way of, for example a hub 71 to which the rear steel rotor plate 58 is securely fastened, by way of, for example bolts or rivets 69, the hub 71 being bolted or otherwise securely fastened to the blower shaft in a conventional manner known to a person skilled in the art), air is drawn into the air inlet 50 (as generally indicated by the arrow 62A) and is drawn through the blower to the air outlet 54 (as generally indicated by the arrows 62 and 62B).

Figures 6A, 6B, 6C, 6D:
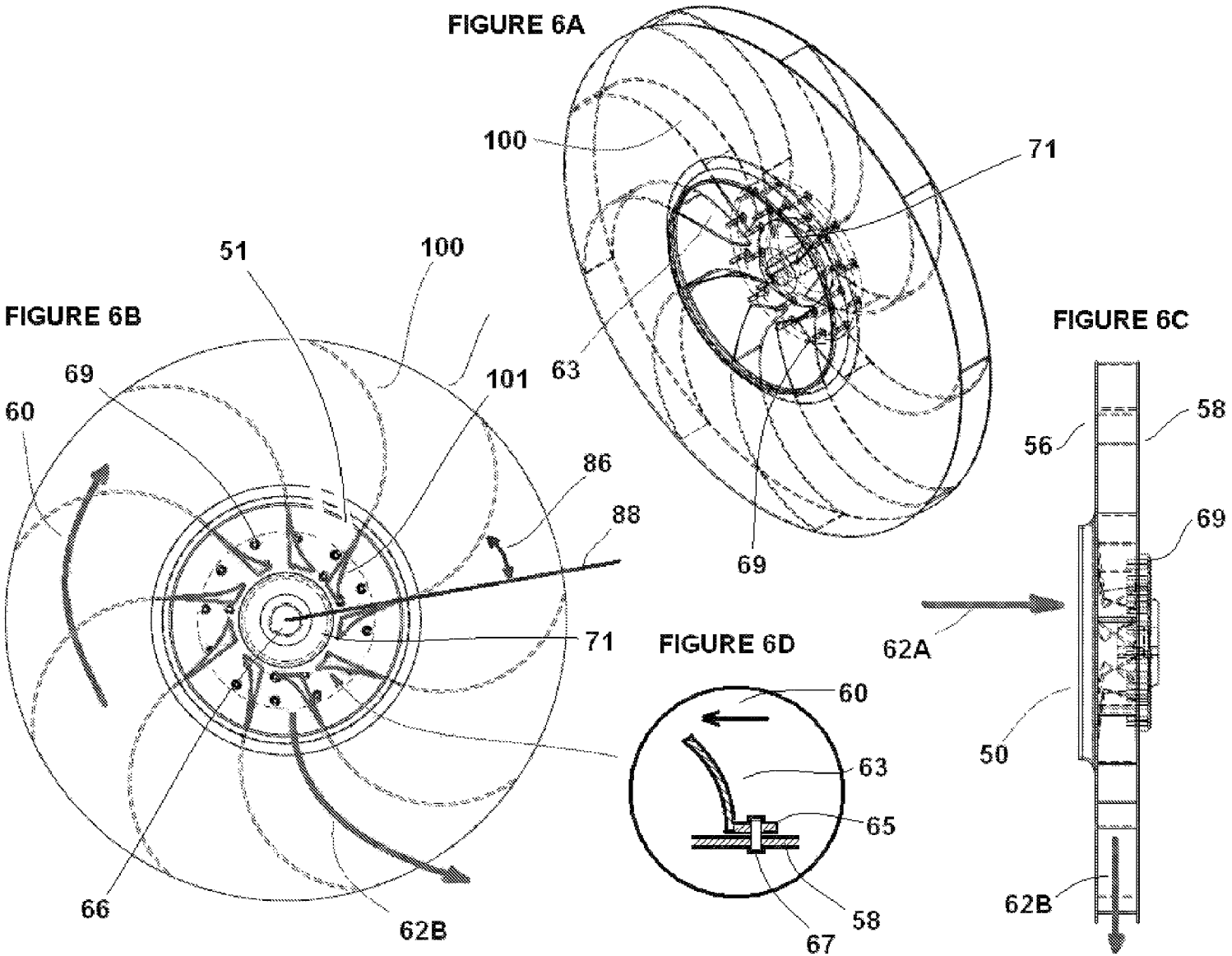
FIG. 6*a* is a perspective view, partially in ghost, of an extended curved blade blower of one embodiment of the present invention having a set of extended curved blades that are gently angled in a forward direction at the proximal end thereof.
FIG. 6*b* is a plan view, partially in ghost, of an extended curved blade blower of the embodiment of the present invention illustrated in FIG. 6*a;*
FIG. 6*c* is a side view, partially in ghost, of an extended curved blade blower of the embodiment of the present invention illustrated in FIG. 6*a;*
FIG. 6*d* is a cross-sectional view of the proximal end of an extended curved blade blower of the embodiment of the present invention illustrated in FIG. 6*a.*

With reference to FIGS. 6*a*, 6*b*, 6*c* and 6*d*, in one embodiment of the present invention, the particulate loader and transfer apparatus has a blower 6 as illustrated in FIGS. 6*a*, 6*b*, 6*c* and 6*d*. In this embodiment of the present invention, the blower 6 preferably has a set of 12 extended curved steel blades 100, each of which is angled (as illustrated by the arrow 86) relative to a radial reference line 88, and each of which is welded, riveted or otherwise securely fastened to a rear steel rotor plate 58 and to a front steel rotor plate 56 (it being understood that while FIGS. 6*a* and 6*b* illustrate 12 curved steel blades 100, fewer than or more than 12 blades may alternatively be used, and while FIGS. 6*a* and 6*b* illustrate the proximal end of the blades 90 at an angle of approximately 20°-45° to the radial reference line 88, a wide range of angles may alternatively be used, and that in alternative embodiments of the present invention, aluminum or other alternative materials may be used for the blades 100, rear steel rotor plate 58 and front steel rotor plate 56). In this embodiment of the present invention the proximal end 101 of each of the blades 100 extends a distance beyond the circumference 51 of the inlet 50 and near the proximal end thereof, the edge of the blade 63 nearest the rotational axis of the blower is gently angled or curved in the direction of rotation 60 as illustrated in the cross-sectional view of the proximal end of the blade illustrated in FIG. 6D (in an alternative embodiment while some of the blades 100 beyond the circumference 51 of the inlet 50, some of the blades 100 extend only to the circumference 51, it being understood that these blades are positioned on the blower 60 in a balanced way so that no portion of the blower is out of balance relative to the other portions of the blower). When the blower is rotated (as indicated by the arrow 60) about the blower shaft 66 to which the rear steel rotor plate 58 is securely fastened (by way of, for example a hub 71 to which the rear steel rotor plate 58 is securely fastened, by way of, for example bolts or rivets 69, the hub 71 being bolted or otherwise securely fastened to the blower shaft in a conventional manner known to a person skilled in the art), air is drawn into the air inlet 50 (as generally indicated by the arrow 62A) and is drawn through the blower to the air outlet 54 (as generally indicated by the arrows 62 and 62B).

The present invention has been described herein with regard to preferred embodiments. However, it will be obvious to persons skilled in the art that a number of variations and modifications can be made without departing from the scope of the invention as described herein.

The embodiments of the invention in which an exclusive property or privilege is claimed are defined as follows:

1. A particulate loader and transfer apparatus, comprising:

an air-materials separating chamber;

a vacuum pickup hose coupled with the air-materials separating chamber for directing particulate materials into the air-materials separating chamber;

separating means within the separating chamber for separating the particulate materials from an air stream;

a discharge conveyor for transferring the particulate materials to a remote location; and, a single stage blower capable of providing sufficient suction in the event the particulate material is difficult to move or the vacuum pickup hose is blocked, the single stage blower comprising:

a. at least one blade having a proximal and a distal end;

b. means for rotating the at least one blade in a direction about an axis of rotation; wherein the proximal end of the blade is nearer to the axis of rotation than the distal end of the blade is to the axis of rotation and wherein the blade is angled so that as the blade rotates about the axis, the proximal end of the blade precedes the distal end of the blade and wherein a substantial portion of the blade is curved; and, c. an inlet disposed concentrically to the axis of rotation and connected to the air-material separating chamber of the particulate loader and transfer apparatus for providing suction thereto.

2. The particulate loader and transfer apparatus defined in claim 1 wherein the proximal end of at least a subset of the at least one blade is extended into the inlet.

3. The particulate loader and transfer apparatus defined in claim 2 wherein an edge of the at least a subset of the at least one blade is angled in the direction of rotation, the edge being in proximity to the proximal end of the respective blade and facing the inlet.

4. A particulate loader and transfer apparatus, comprising:

an air-materials separating chamber;

a vacuum pickup hose coupled with the air-materials separating chamber for directing particulate materials into the air-materials separating chamber;

separating means within the separating chamber for separating the particulate materials from an air stream;

a discharge conveyor for transferring the particulate materials to a remote location; and, a single stage blower capable of providing sufficient suction in the event the particulate material is difficult to move or the vacuum pickup hose is blocked, the single stage blower comprising:

a. a plurality of blades, each blade having a proximal and a distal end;

b. means for rotating the plurality of blades in a direction about an axis of rotation; wherein the proximal end of each blade is nearer to the axis of rotation than the distal end of the blade is to the axis of rotation and wherein each blade is angled so that as the blade rotates about the axis, the proximal end of the blade precedes the distal end of the blade and wherein a substantial portion of each blade is curved; and, c. an inlet disposed concentrically to the axis of rotation and connected to the air-material separating chamber of the particulate loader and transfer apparatus for providing suction thereto.

5. The particulate loader and transfer apparatus defined in claim 4 comprising a plurality of supplemental blades having a shorter length than the blades, each supplemental blade being interposed between two successive blades.

6. The particulate loader and transfer apparatus defined in claim 5 wherein each supplemental blade has a proximal and distal end and wherein the distal end of each supplemental blade is disposed in proximity to the distal ends of the adjacent blades.

7. The particulate loader and transfer apparatus defined in claim 4 wherein the proximal end of at least a subset of the plurality of blades is extended into an inlet disposed concentrically to the axis of rotation.

8. The particulate loader and transfer apparatus defined in claim 7 wherein an edge of the at least a subset of the plurality of blades is angled in the direction of rotation, the edge being in proximity to the proximal end of the respective blade and facing the inlet.

9. A method for transferring particulate materials comprising:

providing an air-materials separating chamber;

providing a vacuum pickup hose coupled with the air-materials separating chamber for directing the particulate materials into the air-materials separating chamber;

providing separating means within the separating chamber for separating the particulate materials from an air stream;

providing a discharge conveyor for transferring the particulate materials to a remote location;

providing a single stage blower having an inlet disposed concentrically to an axis of rotation and connected to the air-materials separating chamber for providing suction thereto, the blower having a plurality of blades rotatable about the axis of rotation;

rotating the plurality of blades in a direction about the axis of rotation, wherein a proximal end of each blade is nearer to the axis of rotation than a distal end of the blade is to the axis of rotation and wherein each blade is angled so that as the blade rotates about the axis, the proximal end of the blade precedes the distal end of the blade and wherein a substantial portion of each blade is curved to provide sufficient suction in the event the particulate material is difficult to move or the vacuum pickup hose connected to the air-material separating chamber is blocked.

10. The method defined in claim 9 comprising:

providing a plurality of supplemental blades having a shorter length than the blades, each supplemental blade being interposed between two successive blades;

rotating the supplemental blades about the axis of rotation.

11. The method defined in claim 9 comprising extending the proximal end of at least a subset of the plurality of blades into the inlet.

* * * * *